United States Patent [19]

Funk

[11] 4,381,742

[45] May 3, 1983

[54] ENGINE COOLANT HEATER

[75] Inventor: Francis C. Funk, Dubuque, Iowa

[73] Assignee: Deere & Company, Moline, Ill.

[21] Appl. No.: 36,863

[22] Filed: May 7, 1979

[51] Int. Cl.[3] ..... F02N 17/02

[52] U.S. Cl. ..... 123/142.5 R; 431/187; 431/284

[58] Field of Search ..... 123/142.5 R, 142.5 E, 123/179 H; 431/187, 243, 284

[56] References Cited

U.S. PATENT DOCUMENTS 2,508,277 5/1950 Leslie ..... 123/142.5 R X
2,623,511 12/1952 Welin-Berger ..... 123/142.5 R
2,681,052 6/1954 Kazial ..... 123/142.5 R
3,131,864 5/1964 Young ..... 123/142.5 R X
4,192,274 3/1980 Damon ..... 123/142.5 R

*Primary Examiner*—Tony M. Argenbright

[57] ABSTRACT

An engine coolant heater comprised generally of a heating tank contained within a combustion chamber having a burner. Fuel is supplied to the burner where the fuel is ignited by an ignition probe in such a manner, that once ignited, continued controlled self-sustained fuel combustion is maintained. Engine coolant contained within the heater is thereby heated and allowed to circulate within an engine to facilitate engine cold-weather starting.

5 Claims, 3 Drawing Figures

ENGINE COOLANT HEATER

BACKGROUND OF THE INVENTION

This invention relates to an engine preheater for use with an internal combustion liquid cooled engines (diesel or gasoline), more specifically to engine preheaters which use the engine coolant to perform an engine preheating function.

Internal combustion engines can be extremely difficult to start in cold weather, particularly the diesel type internal combustion engine. The problem of cold weather starting has often necessitated the relocation of vehicles, for example, a forestry or construction vehicle, many miles to seek shelter from extremely cold weather when not in use for long periods of time. Often a diesel type engine is allowed to idle for substantial amounts of time to avoid the problem of cold weather starting.

Several methods have been devised to assist in cold weather starting of engines. One method is to equip the engine with an electric coolant heater to preheat the engine, however, it is necessary to maintain the vehicle at a location where external energy can be provided when the engine is not in use, which can be a severe limitation with respect to forestry or construction vehicles. A second method most utilized in conjunction with diesel type engines is to inject ethyl ether into the engine when attempting to start the engine. The use of ethyl ether to assist in vehicle starting is not always successful. Also, the repeated use of ethyl ether can have dilatorious affects on the engine.

Another method of assisting in cold weather engine starting is disclosed in U.S. Pat. No. 3,765,389 (Henchel). This patent discloses an apparatus in which atomized diesel fuel is force-injected into a combustion chamber and ignited to raise the temperature of engine coolant. The engine coolant thereafter being used to preheat the engine. The apparatus disclosed in U.S. Pat. No. 3,765,383, however, requires a not insubstantial amount of continuous electrical power presumably when used in conjunction with a vehicle from the vehicle battery. Noting that in cold temperatures, a vehicle battery has a reduced charge-storage capacity, the apparatus described in U.S. Pat. No. 3,765,383 by drawing power from the battery continuously, may result in insufficient remaining battery charge to start the engine. Further, the apparatus described in U.S. Pat. No 3,765,389 is relatively complicated to construct which could represent a rather high cost factor.

The present invention discloses an apparatus to assist in engine cold weather starting to avoid the disadvantages of the aforementioned methods and apparatus.

SUMMARY OF THE INVENTION

The engine coolant preheater includes a combustion chamber having a burner and contained heating tank. Fuel is continuously delivered in a metered amount to the burner. An electrical resistance probe is used to ignite the fuel, thereafter fuel combustion is self-sustaining and continuous. The release of thermal energy as a result of fuel combustion is transmitted to the engine coolant contained within the heating tank. The heated coolant is then allowed to circulate through the engine, thereby preheating the engine.

It is an objective of the present invention to present a means of preheating an engine to facilitate easy cold starting of the engine.

It is a further object of the present invention to present a preheater which requires reduced amounts of electrical energy. The electrical energy requirements of the present invention can be met by a separate battery source or by a vehicle battery without substantially reducing the vehicle's battery discharge capability.

DESCRIPTION OF THE PREFERRED EMBODIMENT

Figure 1:
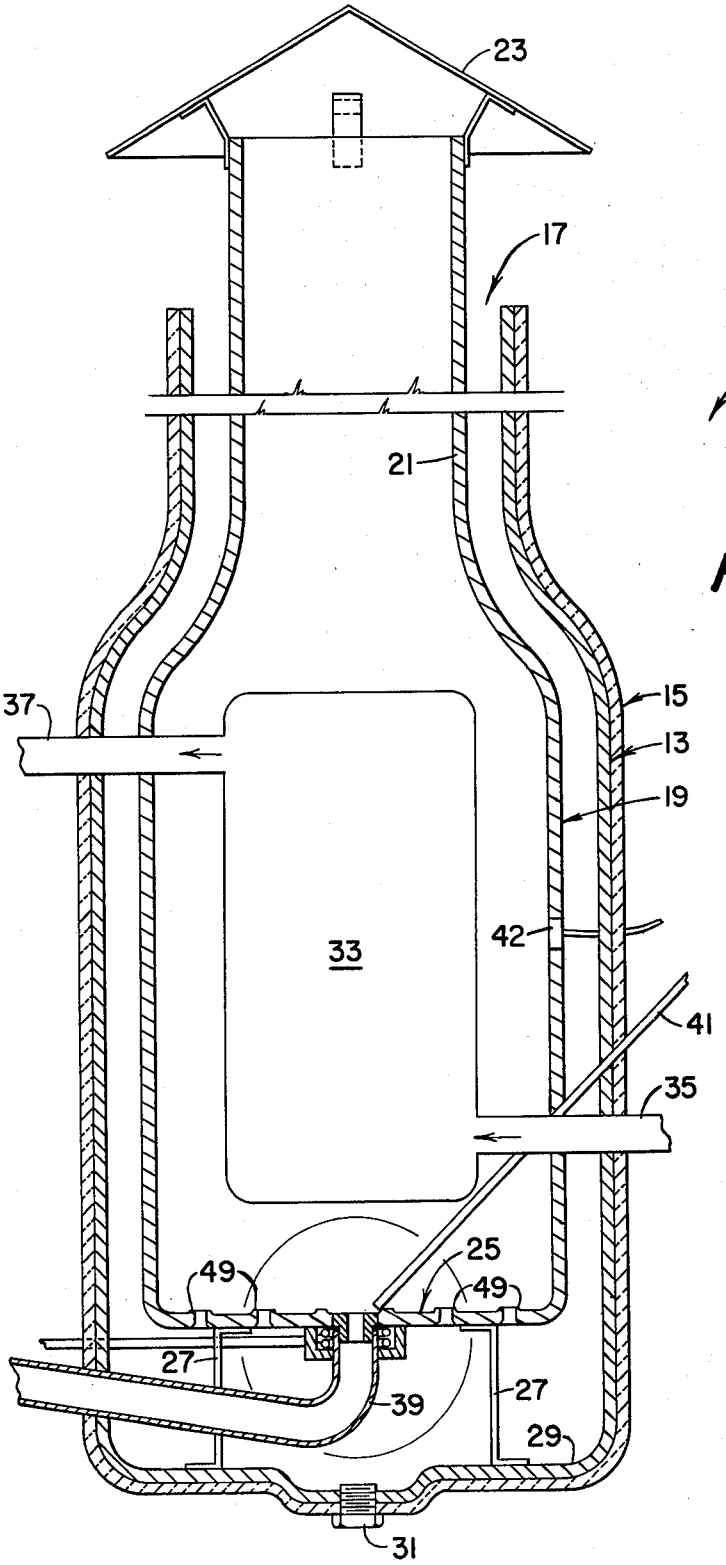
FIG. 1 is a sectioned elevational view of the engine coolant preheater.

Referring to FIG. 1, the engine coolant heater, generally indicated as 11, includes a housing 13 with an insulation cover 15 to promote thermal efficiency of the engine coolant heater 11. The top of housing 13 has an opening 17. Contained within the housing 13 is a combustion chamber 19 which includes a stack 21 which extends vertically through opening 17. The stack 21 has fixably mounted thereto by any conventional means a hood 23 to prevent foreign objects from entering the combustion chamber 19. The combustion chamber 19 further includes a burner 25, which in the preferred embodiment forms the base of the combustion chamber 19. A plurality of members 27 are fixably mounted by any conventional means such as by welding to the bottom of burner 25 and the housing base 29 to support the combustion chamber 19 and stack 21 within the housing 13. The housing further includes a drain plug 31 screwably mounted in the base 29 to permit draining.

A coolant heating tank 33 is mounted within the combustion chamber 19. The coolant heating tank 33 includes a coolant inlet tube 35 and a coolant outlet tube 37 which journeys through the combustion chamber 19 and the housing 13 in a fitted manner to fixably support the coolant heating tank 33 within the combustion chamber 19. The inlet tube 35 and outlet tube 37 communicate with an engine cooling system (not shown).

In operation fuel is continuously delivered to the engine coolant heater 11 from a fuel source (not shown) through a fuel line 39 to the burner 25 in metered amounts, the fuel being gravity fed or pump motivated through line 39. The fuel may be of any suitable type, e.g., gasoline, diesel fuel, ethyl ether, etc. To initiate fuel combustion, a resistance probe 41 is electrically energized by any conventional means to deliver sufficient thermal energy to the burner 25 contained fuel to initiate combustion. After the fuel is ignited by resistance ignition probe 41, a temperature sensor 42 will cause the resistance ignition probe 41 to be de-energized in any conventional manner, e.g., sensor 42 can activate a switching means to remove electrical potential from probe 41. It is noted that it is not necessary to atomize the fuel ignition and, because the fuel is delivered in a metered amount, the combustion rate is controlled. Ignition probe 41 can be composed of a nickel or nickel chromium alloy, which substances when subjected to electrical stimulus will generate sufficient thermal energy to ignite diesel fuel if employed in the preferred embodiment of the preferred embodiment.

The heater tank 33 is located in proximity to the burner 25 to receive substantial amounts of thermal energy generated as a result of fuel combustion, therefrom transmitting the received thermal energy to the contained coolant. The coolant outlet tube 37 is vertically elevated with respect to the coolant inlet tube 35, such that, the acquisition of thermal energy by the contained coolant will increase the kinetic energy of the coolant to allow the coolant to be self-motivated to discharge from the heating tank 33 and circulate within an engine, eliminating the necessity for a pump to stimulate coolant circulation in an engine.

Figure 2:
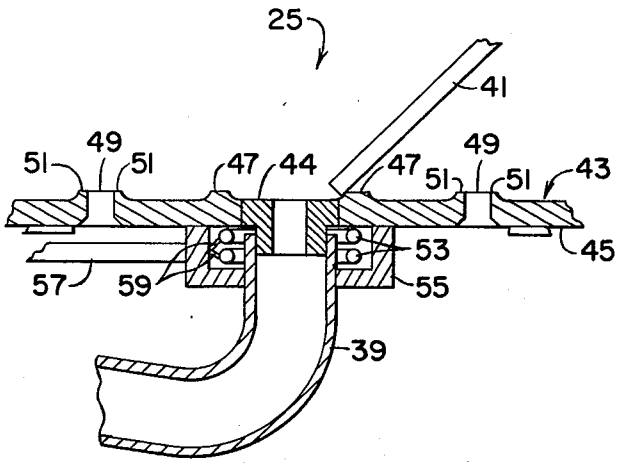
FIG. 2 is a sectional elevational view of the preheater burner.

Referring to FIG. 1 and, more particularly to FIG. 2, the burner 25 of the combustion chamber 19 includes a base 43 having a metering orifice member 44 extending vertically through and slightly beyond the bottom 45 of base 43. The fuel line 39 is in fitted communication with the metering orifice member 44 beneath the base 43. The base 43 has a shallow ringed ridge 47 formed therein encircling the metering orifice member 44 atop base 43. The resistance ignition probe 41 journeys through the housing 13 into the combustion chamber 19 to a point just inside the ringed ridge 47. The base 43 also has a plurality of holes 49 extending vertically therethrough. Because of the spacing between the combustion chamber 19 and stack 21 with respect to the housing 13 external air is permitted to travel unassisted therebetween and beneath base 43 through holes 49 to facilitate in fuel combustion.

To promote fuel ignition, fuel delivered through line 39 and metering orifice 44 collects within ring ridge 47. The heating rod 41 is positioned to directly communicate with fuel collected within ridge 47 and is electrically stimulated by any conventional means to obtain a temperature sufficient to ignite for fuel. For example, in the case of No. 2 diesel fuel the ignition temperature is between 500° to 800° F. After ignition is obtained, heating rod 41 is de-energized in a manner aforementioned, fuel combustion thereafter being self-sustaining. The metering orifice 44 allows a sufficient fuel flow for continuous combustion. The holes 49 in base 43 have formed ridge 51 therearound atop base 43 of sufficient elevation to protect against spillage of fuel through the holes 49.

To assist flow through the metering orifice 44 when heavy fuels are to be used, for example diesel fuel, an electrical resistance heating coil 53 can be employed. The heating coil 53 is fixably mounted to and beneath base 43 by any conventional jmeans encircling the area of communication between line 39 and metering orifice 44. Also, fixably mounted by any conventional means to the bottom 45 of base 43 is a housing ring 55 which in conjunction with bottom 45 of base 43 partially encases the heating coil 53 to promote thermal efficiency. Conduit 57 carries electrical lines 59 to the heating coil 53 to enable coil 53 to be electrically energized by any conventional means.

Figure 3:
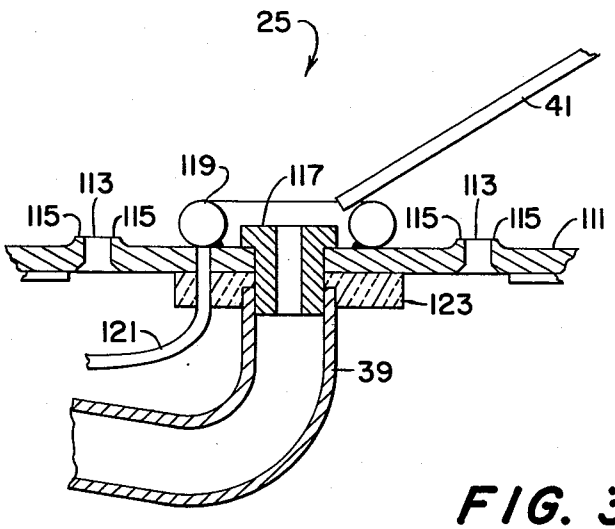
FIG. 3 is a sectioned elevational view of an alternative preheater burner.

Referring to FIG. 3, an alternative burner 25 includes a base 111 having a plurality of holes 113 extending vertically therethrough. Holes 113 in base 111 have formed ridge 115 therearound atop base 111 of sufficient elevation to protect against spillage of fuel through the holes 113. A metering orifice 117 is contained in base 111 in fitted communication with line 39 beneath base 111. Encircling the metering orifice 117 on the top of base 111 is an electrical resistance heating element 119 which has a conduit 121 extending through the base 111 communicating with heating element 119 containing power lines (not shown). The heating element 19 creates a heat well to assist fuel flow through the orifice 117 in addition to promoting fuel ignition. Aligned below the heating element 119 mounted to the underside of base 111 is insulating material 123 encircling the area of communication between the metering orifice 117 and fuel line 39 just below base 111. In the alternative embodiment fluid which is transmitted from line 39 through metering orifice 117 is heated by elements 119, ignition probe 41 which extends slightly within the heat well formed by heating element 119 is electrically energized to achieve ignition. Once the ignition is achieved, fuel combustion is self-sustaining and continuous.

The preferred embodiments of the present invention are particularly compatible for use in a vehicle in conjunction with an on board micro-processor. The microprocessor can be programmed to activate the engine coolant heater 11 in a manner aforedescribed at a particular time and deactivate the coolant heater 11 when the engine coolant has reached a certain inlet temperature.

It is noted, that in the preferred embodiments of the present invention, probe 41 only requires electrical power for a short period of time sufficient to ignite a fuel. The electrical power requirement of heating coil 53 or heating element 119 in the alternative embodiment is relatively small since their function is to only supply sufficient heat to promote through orifices 44 or 117, respectively, and need not be used unless a heavy fuel is used in the presence of an extremely cold environment. The orifices 44 and 117 are sized to permit a flow rate sufficient to have controlled fuel combustion.

I claim:

1. An engine coolant heater for use in conjunction with a liquid-cooled engine, said engine coolant heater to use a combustible fuel:

(a) a housing;

(b) a combustion chamber fixably mounted in said housing;

(c) fuel delivery means for delivering said combustible fuel;

(d) fuel ignition means for providing sufficient thermal energy to ignite said combustible fuel;

(e) burner means for receiving and containing said combustible fuel from said fuel delivery means in sufficient proximity to said fuel ignition means such that said combustible fuel can be ignited by fuel ignition means, said burner means to receiving said combustible fuel at a rate sufficient to support controlled continued self-sustained combustion of said combustible fuel, said burner means including;

(i) a base having a plurality of holes extending vertically through said base, said base to contain a formed rim elevated as compared to the top surface of said base around each of said holes;

(ii) a metering orifice fixably mounted in said base and extending slightly beyond said bottom of said base in communication with said fuel delivery means;

(f) a coolant tank fixably mounted in said combustion chamber in sufficient proximity to said burner means to receive appreciable amounts of thermal energy resulting from said fuel combustion, said coolant tank being thermal-energy conductive;

(g) coolant inlet means for admitting coolant from said engine into said coolant tank;

(h) coolant outlet means for permitting coolant to flow from said coolant tank once said coolant has received a sufficient amount of thermal-energy to said engine.

2. An engine coolant heater as claimed in claim 1 wherein said burner means, further comprises: an electrical resistance heating coil fixably mounted beneath said base encircling that portion of said metering orifice extending beyond said bottom of said base in communication with said fuel delivery means.

3. An engine coolant heater as claimed in claim 2 wherein said burner means, further comprises a housing around said heating coil and encircling a portion of said metering orifice fixably mounted to said bottom of said base.

4. An engine coolant heater as claimed in claim 1, 2 or 3 wherein said burner means, further comprises an electrical resistance heating element fixably mounted to the top of said base encircling said metering orifice opening.

5. An engine coolant heater as claimed in claim 1 wherein said fuel ignition means comprises an electrical resistance heating probe.

* * * * *

UNITED STATES PATENT AND TRADEMARK OFFICE

CERTIFICATE OF CORRECTION

PATENT NO. : 4,381,742

DATED : 3 May 1983

INVENTOR(S) : Francis C. Funk

It is certified that error appears in the above-identified patent and that said Letters Patent is hereby corrected as shown below:

Column 4, line 47, after "by", insert -- said --.

Signed and Sealed this

*Twenty-second* Day of *November 1983*

[SEAL]

*Attest:*

GERALD J. MOSSINGHOFF

*Attesting Officer*

*Commissioner of Patents and Trademarks*